US005251562A

United States Patent [19]

Chemiere et al.

[11] Patent Number: 5,251,562

[45] Date of Patent: Oct. 12, 1993

[54] DEVICE FOR AERODYNAMICALLY STABILIZING A BOMBLET

[75] Inventors: Patrice H. Chemiere, La Chapelle Saint Ursin; Jean-Paul A. Dupuy, Bourges, both of France

[73] Assignee: Giat Industries, Versailles, France

[21] Appl. No.: 961,636

[22] Filed: Oct. 16, 1992

[30] Foreign Application Priority Data

Oct. 17, 1991 [FR] France ..... 91 12797

[51] Int. Cl.[5] ..... F42B 12/58

[52] U.S. Cl. ..... 102/386; 102/393; 102/489

[58] Field of Search ..... 102/386, 387, 388, 393, 102/489, 337; 244/138 A

[56] References Cited

U.S. PATENT DOCUMENTS 4,418,624 12/1983 Willi et al. ..... 102/386
4,488,488 12/1984 Lodger et al. ..... 102/387
4,958,566 9/1990 Siebrand et al. ..... 102/386
4,986,185 1/1991 Kuhnle et al. ..... 102/388
5,016,533 5/1991 Börngen ..... 102/386

FOREIGN PATENT DOCUMENTS 0063680 11/1982 European Pat. Off. .
0124072 11/1984 European Pat. Off. .
2650661 2/1991 France .

*Primary Examiner*—David H. Brown
*Attorney, Agent, or Firm*—Oliff & Berridge

[57] ABSTRACT

A device with a stabilizing ribbon fastened to the rear of the body of a bomblet includes a first loop of ribbon with a relatively long lengthwise dimension and a second loop of ribbon with a relatively short lengthwise dimension. The two loops are fastened to the same point on the rear of the body and are rotationally integral with each other. The device improves the deployment of the stabilizing ribbon and the aerodynamic stabilizing and braking of a bomblet.

19 Claims, 2 Drawing Sheets

DEVICE FOR AERODYNAMICALLY STABILIZING A BOMBLET

BACKGROUND OF THE INVENTION

The present invention relates to submunitions consisting of bomblets, for example anti-vehicle and anti-personnel bomblets, which are released at altitude by a vector such as a dispenser shell.

The terminal effectiveness of these bomblets requires that, at the moment of their impact on the target, they be in a position as close as possible to a vertical position to ensure proper operation of the fusing device. Moreover, in the case of an anti-vehicular bomblet comprising a hollow charge, the charge must be pointing downward.

It is therefore advantageous to control the attitude of the bomblet over its trajectory, and especially in its terminal phase In a known manner, bomblets receive a stabilizing parachute ribbon in the form of a simple cloth ring of constant width, mounted on the upper end of the percussion fuse, which is in turn mounted so it is free to rotate with respect to the body of the bomblet. This ribbon, as a result of its aerodynamic drag, tends to ensure proper alignment of the ribbon and bomblet body assembly, and therefore proper positioning of the bomblet as it falls. However, this proper positioning is not consistently achieved, due to the ribbon deploying improperly or too late, resulting in functional problems upon impact.

In order to remedy the problem of the flight of bomblets as they are released, patent FR 2 650 661 proposes a stabilizing ribbon of variable width. The top of the ribbon has a greater width in order to increase aerodynamic drag. Since the ribbons are generally produced by weaving, this device has the disadvantage of being more difficult to produce and thus more costly, while it does not produce a sufficient improvement in the flight of the bomblet.

SUMMARY OF THE INVENTION

It is an object of the present invention to produce a stabilizing device for bomblets that is simple to produce and low in cost, while providing a perceptible improvement in the flight of the bomblet on which it is installed.

This and other objects are achieved by providing a device that can be attached to the rear of the body of a bomblet to brake the bomblet aerodynamically and to stabilize its attitude during descent, including a parachute ribbon of constant width forming a loop with a lengthwise dimension substantially greater than the lengthwise dimension of the body of the bomblet, characterized in that it includes, in the region where the loop is fastened to the body, a member which extends to either side of the region and which acts to partially deploy the two ends of the loop in the vicinity of the region.

Because the member is present in the fastening region of the loop, the loop is in a partially deployed position practically as soon as the bomblet is released. Complete deployment of the loop then occurs very rapidly in response to the speed of its fall.

According to a preferred embodiment, the partial deployment member is a ribbon forming a supplementary loop with a lengthwise dimension substantially less than that of the loop being deployed.

According to another embodiment of the invention, the partial deployment member is a flexible strip, curved along its lengthwise dimension. The strip is attached to a portion of the ribbon of the loop being deployed, in the fastening region, and is integral with the ribbon.

Another object of the present invention is to provide a bomblet equipped with a braking and stabilizing device according to one of the embodiments above.

BRIEF DESCRIPTION OF THE DRAWINGS

Other details and advantages of the invention will become evident from the following detailed description of embodiments of the present invention, with reference to the attached drawings in which.

DETAILED DESCRIPTION OF PREFERRED EMBODIMENTS

Figure 1:
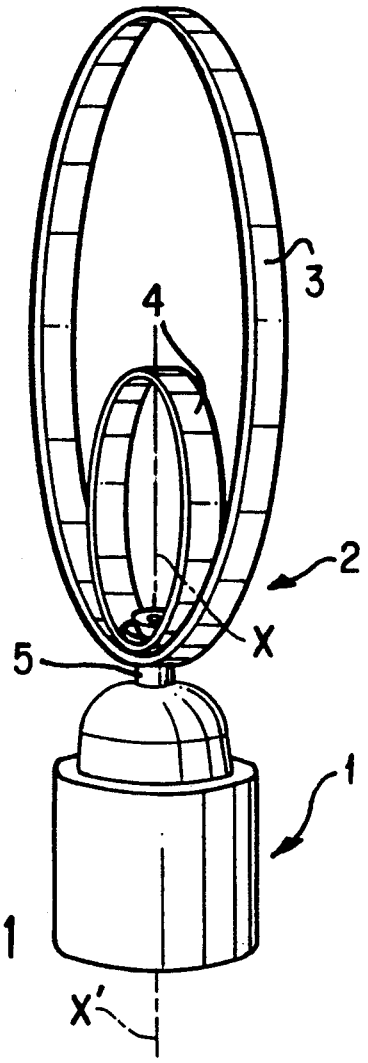
FIG. 1 is a perspective view of a bomblet comprising a stabilizing ribbon according to the invention.
Figure 2:
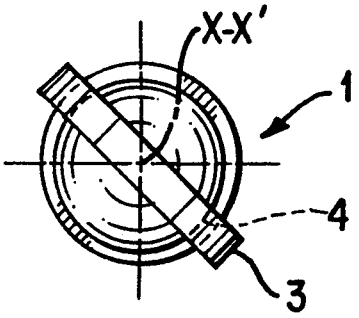
FIG. 2 is a view of FIG. 1 from above.

According to a first embodiment of the invention (FIGS. 1 to 3), a stabilizing ribbon 2 according to the invention is fastened onto a bomblet with an axis X—X'.

As an example, the bomblet can be of the type described in FR-A-2 650 662, and it is designed to be directed towards its target by means of a dispenser shell. A bomblet of this type comprises a percussion fuse 5 having a free end which is defined at the rear of the bomblet, onto which stabilizing ribbon 2 is fastened.

Stabilizing ribbon 2, made for example of a woven polyamide fiber such as nylon or rilsan, comprises a loop 3 having a lengthwise dimension substantially greater than that of bomblet body 1. Inside loop 3, stabilizing ribbon 2 comprises a small loop 4 with a lengthwise dimension substantially less than that of loop 3. Loops 3 and 4 are disposed substantially in the same axial plane with reference to bomblet body 1.

In a non-limiting manner, for a bomblet body 1 that is 90 mm long and 43 mm wide, it is possible to use a loop 3 whose ribbon has a total length of 500 mm, and a loop 4 whose ribbon has a total length of 125 mm. In both cases, the width of the ribbon is 19 mm.

Figure 3:
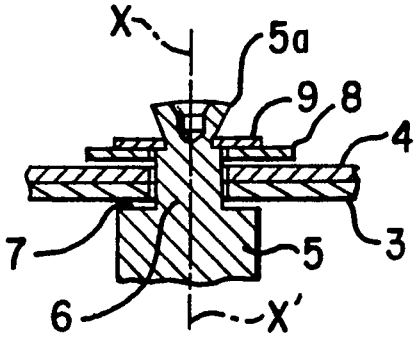
FIG. 3 is a partial axial sectioned view, at enlarged scale, of the free end of the percussion fuse of FIG. 1.

The ribbons of loops 3 and 4 are fastened to one another by being sewn and/or adhesively bonded, and the fastening region, which thus has a double thickness, is in turn fastened to the free end of percussion fuse 5 (see FIG. 3). For this purpose, the percussion fuse has in its terminal part a cylindrical contraction 6 delimited by a peripheral shoulder 7. When a hole has been made in the double thickness area of the fastening region of the ribbon, with a diameter slightly greater than that of cylindrical contraction 6, the two ribbon loops 3, 4 can be slid onto the latter, and allowed to rest on peripheral shoulder 7 so that the double thickness area is free to rotate.

The double thickness area is retained by a retaining washer 8, which is also free to rotate and is in turn retained on cylindrical part 6 by a washer 9 crimped onto end 5*a* of percussion fuse 5.

The above device operates as follows:

Initially, the bomblet is placed in a dispenser shell, the two ribbon loops 3, 4 are folded longitudinally so as not to exceed the available volume. In this operation, loop 4 needs only to be slightly folded, since its total length (i.e., 125 mm) is not much greater than twice the diameter of body 1 (i.e., 43 mm).

After release of the bomblet, the small loop of ribbon 4 deploys correctly very quickly. Since there is only a small number of folds and since the ribbon still has a certain transverse stiffness, there is little risk that an unfavorable configuration (kinking, tangled lateral portions of the loop, etc.) will occur.

After this first braking and stabilizing action, large loop 3 can deploy under good conditions. Referring to FIG. 3, the two ends of the loop are spaced apart from one another in the vicinity of the attachment point at the rear of the bomblet. These ends are guided to some extent by the attachment with the ribbon of loop 4 in the fastening region, which has already deployed. The main braking and stabilizing force produced by main loop 3 is thus obtained more rapidly and with much better reliability than that with the prior art devices.

Figure 4:
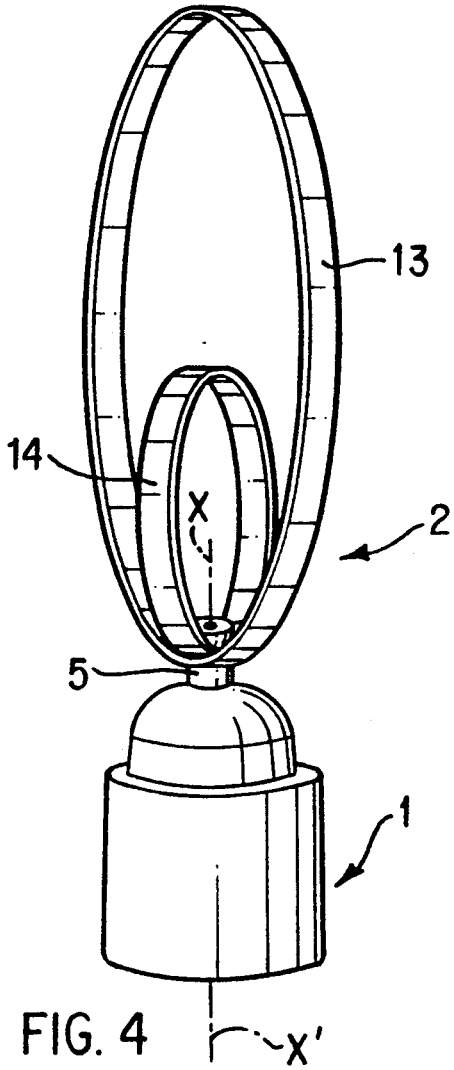
FIG. 4 is a perspective view of a second embodiment of the invention.
Figure 5:
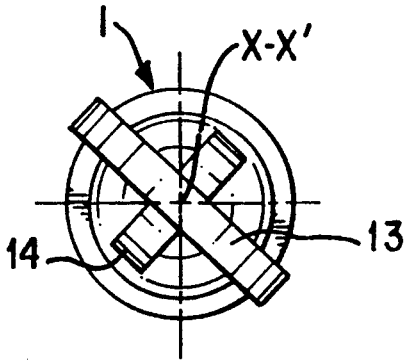
FIG. 5 is a view of FIG. 3 from above.

According to another embodiment depicted in FIGS. 4 and 5, the two loops 13 and 14 are located in two axial planes of bomblet body 1, substantially perpendicular to one another.

Operation is similar to that of the first embodiment, except for the portions of small loop 14 used for deployment of main loop 13 in connection with the spacing and guiding portions main loop 13. The portion of loop 14 located opposite the attachment point plays a more important role here. It acts to create a slight overpressure in the region that it sweeps in the vicinity of the attachment point. This overpressure constitutes a favorable factor in spacing the two ends of loop 13 apart from one another in the vicinity of the attachment.

Figure 6:
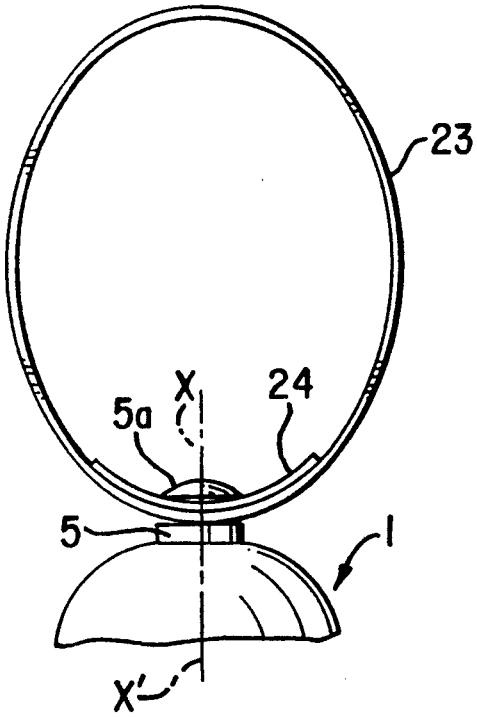
FIG. 6 is a front view of another embodiment of the invention.

According to a third embodiment of the invention (see FIG. 6), a thin flexible curved strip 24, preferably having a width equal to that of the ribbon of loop 23 and a length less than the diameter of bomblet body 1, is used instead of loop 4 or 14. The strip is made, for example, of a plastic material.

Strip 24 is fastened at its center to the attachment point of the ribbon of loop 23, and is integral with a portion of the ribbon. The fastening method can be similar to that for the first two embodiments (see FIG. 3), and can comprise, for example, adhesive bonding of the strip onto the ribbon. Preferably strip 24 is arranged on the ribbon inside loop 23.

During storage in the dispenser shell, flexible strip 24 can be curved in the opposite direction to match the shape of the back of bomblet body 1. As a result, the overall volume of the device remains the same.

Operation of the third embodiment is similar to that of the first two, except that spacing member 24 acts immediately upon release of the bomblet, while previously its action did not occur until after the short time necessary for deployment of loop 4 or 14.

Of course, the invention is not limited to the exemplary embodiments that have just been described, and numerous modifications can be made to it without departing from the scope of the invention, which is outlined in the following claims.

We claim:

1. An apparatus for aerodynamically braking and stabilizing a bomblet, comprising:

a parachute ribbon having a substantially constant width and being attached to a body of said bomblet in a fastening region so as to form a loop, said loop having a lengthwise dimension greater than a lengthwise dimension of said body; and at least one member attached to said bomblet body and extending to either side of said fastening region for partially deploying said parachute ribbon.

2. The apparatus according to claim 1, wherein said member is a flexible strip curved along its lengthwise dimension, said strip being integral with said loop formed by said parachute ribbon in the fastening region.

3. The apparatus according to claim 2, wherein the lengthwise dimension of said strip is less than the lengthwise dimension of said body.

4. The apparatus according to claim 2, wherein said strip is substantially rectangular and has a width substantially equal to said width of the parachute ribbon forming said loop.

5. The apparatus according to claim 4, wherein the lengthwise dimension of said strip is less than the lengthwise dimension of said body.

6. The apparatus according to claim 2, wherein said strip is arranged inside said loop.

7. The apparatus according to claim 6, wherein the lengthwise dimension of said strip is less than the lengthwise dimension of said body.

8. The apparatus according to claim 6, wherein said strip is substantially rectangular and has a width substantially equal to said width of the parachute ribbon forming said loop.

9. The apparatus according to claim 1, wherein said member is a ribbon forming a supplementary loop with a lengthwise dimension substantially less than the lengthwise dimension of said loop formed by said parachute ribbon.

10. The apparatus according to claim 9, wherein said loops are arranged in the same axial plane with respect to said body, said supplementary loop being disposed inside said loop formed by said parachute ribbon.

11. The apparatus according to claim 9, wherein said ribbon forming said supplementary loop has a substantially constant width substantially equal to said width of the parachute ribbon forming the other loop.

12. The apparatus according to claim 9, wherein said loops are arranged in two axial planes.

13. The apparatus according to claim 12, wherein said two axial planes are substantially perpendicular to one another.

14. The apparatus according to claim 9, wherein said supplementary loop is integral with said loop formed by said parachute ribbon in the fastening region.

15. The apparatus according to claim 14, wherein said loops are made integral by sewing.

16. The apparatus according to claim 14, wherein said loops are made integral by adhesive bonding.

17. The apparatus according to claim 14, wherein said loops are arranged in the same axial plane with respect to said body, said supplementary loop being disposed inside said loop formed by said parachute ribbon.

18. The apparatus according to claim 14, wherein said loops are arranged in two axial planes.

19. The apparatus according to claim 18, wherein said two axial planes are substantially perpendicular to one another.

* * * * *